US007771000B2

(12) United States Patent
Iesaki

(10) Patent No.: US 7,771,000 B2
(45) Date of Patent: Aug. 10, 2010

(54) SETTING METHOD AND IMAGE FORMING APPARATUS

(75) Inventor: Kenichi Iesaki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 386 days.

(21) Appl. No.: 12/022,108

(22) Filed: Jan. 29, 2008

(65) Prior Publication Data

US 2008/0211846 A1 Sep. 4, 2008

(30) Foreign Application Priority Data

Jan. 29, 2007 (JP) ..... 2007-018402

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 6,149,263 A * 11/2000 Nakano ..... 347/43

FOREIGN PATENT DOCUMENTS

JP 9240098 A 9/1997
JP 10100398 A 4/1998
JP 2005178334 A 7/2005

OTHER PUBLICATIONS

Machine translation of claims and detailed description of JP 10-100398 A.*

* cited by examiner

*Primary Examiner*—Matthew Luu
*Assistant Examiner*—Justin Seo
(74) *Attorney, Agent, or Firm*—Baker Botts L.L.P.

(57) ABSTRACT

A method is provided for setting a target moving velocity of a carriage in an image forming apparatus wherein a recording head is driven at a driving frequency proportional to a moving velocity of the carriage. The method includes steps of: varying the driving frequency of the recording head proportional to the moving velocity of the carriage so as to measure an ejection velocity of ink droplets ejected from nozzles of the recording head; deriving a velocity range where the ejection velocity of ink droplets from the nozzles of the recording head is increased as the moving velocity of the carriage is increased; calculating a control error between the target moving velocity and an actual moving velocity of the carriage; and setting the target moving velocity of the carriage such that the actual moving velocity of the carriage is within the velocity range based on the calculated control error.

10 Claims, 10 Drawing Sheets

SETTING METHOD AND IMAGE FORMING APPARATUS

CROSS-REFERENCE TO RELATED APPLICATIONS

This application claims the benefit of Japanese Patent Application No. 2007-018402 filed Jan. 29, 2007 in the Japan Patent Office, the disclosure of which is incorporated herein by reference.

BACKGROUND

The present invention relates to a setting method of a target moving velocity of a carriage, and an image forming apparatus utilizing the setting method.

Conventionally, an inkjet image forming apparatus is known which, for example, applies a driving voltage to a recording head to vibrate a piezoelectric portion of the recording head, thereby making the recording head eject ink droplets from nozzles of the recording head.

Generally, the recording head is mounted on a carriage. Upon execution of an image forming process, the image forming apparatus moves the carriage in a main scanning direction to displace the recording head in the main scanning direction. Also, the image forming apparatus controls the recording head so that ink droplets are ejected onto an opposed recording sheet. In this manner, the image forming apparatus forms an image onto the recording sheet.

A well-known image forming apparatus of the above type conveys a carriage in a main scanning direction by a driving force of a motor (DC motor or the like).

SUMMARY

In case that a carriage is moved in a main scanning direction by a driving force of a motor, a moving velocity (actual velocity) of the carriage is fluctuated, as shown in FIG. 4, due to cogging of the motor, eccentricity of a pulley, etc., even though the motor is controlled such that the carriage moves at a constant velocity. Because of this fluctuation, the landing position of ink is shifted from the intended position, resulting in deterioration of image quality. For this reason, various measures have been taken for so long against the problem of deterioration of image quality caused by the fluctuation of the carriage moving velocity.

For example, when a moving velocity of a carriage is periodically fluctuated, a conventional image forming apparatus is known to correct a target moving velocity of the carriage in accordance with the fluctuation so as to perform motor control. In this manner, the image forming apparatus inhibits fluctuation in moving velocity of the carriage.

If the recording head is driven, ignoring fluctuation in moving velocity of the carriage, ink droplets are ejected from the nozzles at a position different from the intended position, and landed at a position different from the intended position on a recording sheet. Therefore, a conventional image forming apparatus is designed to drive the recording head in synchronization with the movement of the carriage, so that ink droplets are ejected from the nozzles at the intended position independent of the fluctuation in moving velocity of the carriage.

However, there is a limit to a controllable amount of fluctuation in the above techniques of correcting the target moving velocity of the carriage to inhibit the fluctuation in moving velocity of the carriage. Thus, deterioration of image quality cannot be sufficiently suppressed when forming an image with high resolution.

In case that the recording head is driven in synchronization with the movement of the carriage, ejected positions of ink droplets can be held constant independent of the fluctuation in moving velocity of the carriage. However, there is still a problem that a distance from the ejected position to the landing position of ink droplets is varied due to the fluctuation in moving velocity of the carriage. Accordingly, ink droplets cannot be landed at the target position with precision.

That is, the above techniques can solve the problem with respect to a shift in landing position of ink droplets caused by a shift in ejection timing deriving from the fluctuation in moving velocity of the carriage. However, the shift in landing position cannot be removed which are caused by a velocity vector at ink ejection fluctuating in conjunction with the moving velocity of the carriage.

It is desirable that an inkjet image forming apparatus of the present invention provides a technique that can inhibit a shift in landing position of ink droplets from a target position more easily than before.

The present invention utilizes a phenomenon that an ejection velocity Vd of ink droplets ejected from nozzles of a recording head is changed by a driving frequency of the recording head and a phenomenon that a distance D from an ejected position to a landing position of ink droplets is changed by the ejection velocity Vd of ink droplets and a carriage moving velocity Vc, thereby to inhibit a shift in landing position of ink droplets caused by fluctuation of the carriage moving velocity Vc. The ejection velocity Vd of ink droplets here indicates an initial velocity of ink droplets ejected from the nozzles in a coordinate system based on the moving carriage. The ejected position indicates a position where ejected ink droplets cast a reflection on a recording sheet.

Particularly, one aspect of the present invention provides a method for setting a target moving velocity of a carriage in an image forming apparatus wherein a recording head is driven at a driving frequency proportional to a moving velocity of the carriage. The method includes steps of: measuring an ejection velocity of ink droplets ejected from nozzles of the recording head by varying the driving frequency of the recording head proportional to the moving velocity of the carriage; deriving a velocity range where the ejection velocity of ink droplets from the nozzles of the recording head is increased as the moving velocity of the carriage is increased; calculating a control error between the target moving velocity and an actual moving velocity of the carriage; and setting the target moving velocity of the carriage such that the actual moving velocity of the carriage stays within the velocity range based on the calculated control error.

As noted above, the ejection velocity Vd of ink droplets is varied according to the driving frequency of the recording head. However, as shown in FIG. 10B, the ejection velocity Vd of ink droplets follows a locus having a slope changing from positive to negative with respect to the driving frequency. On the other hand, the carriage moving velocity Vc is directly proportional to the driving frequency of the recording head.

Let us consider how the distance D from an ejected position to a landing position of ink droplets would be changed with reference to a relation among the driving frequency, the carriage moving velocity Vc, and the ejection velocity Vd of the ink droplets. In case that the carriage moving velocity Vc is fluctuated in a frequency region where the ejection velocity Vd is decreased when the driving frequency is increased, the ejection velocity Vd is decreased when the carriage moving velocity Vc is increased and the ejection velocity Vd is increased when the carriage moving velocity Vc is decreased, as shown in a region A of FIG. 7A. Thus, an amount of change of the distance D becomes larger than the case when the ejection velocity Vd is constant independent of the carriage moving velocity Vc, as shown in FIG. 8A. Here, it should be noted that a distance between the recording head and the recording sheet is constant regardless of the movement of the carriage.

In case that the carriage moving velocity Vc is fluctuated in a frequency region where the ejection velocity Vd is increased when the driving frequency is increased, the ejection velocity Vd is increased when the carriage moving velocity Vc is increased and the ejection velocity Vd is decreased when the carriage moving velocity Vc is decreased, as shown in a region B of FIG. 7A. Thus, the amount of change of the distance D becomes smaller than the case where the ejection velocity Vd is constant independent of the carriage moving velocity Vc (see FIG. 8B).

The present invention focuses attention to these phenomena. That is, the target moving velocity of the carriage is set to a velocity within a velocity range (region B in FIG. 7) where the ejection velocity of ink droplets from the nozzles is increased as the moving velocity of the carriage is increased. Even if the velocity is set to the target moving velocity, the moving velocity (actual velocity) of the carriage stays within the velocity range.

If the target moving velocity of the carriage is set as such, fluctuation of the distance D can be controlled even if the carriage moving velocity is fluctuated due to cogging of a motor or eccentricity of a pulley. A shift in landing position of ink droplets from the target position can be inhibited. Also, according to the present invention, a shift in landing position of ink droplets from the target position can be inhibited just by setting the target moving velocity of the carriage as noted above. Quality of an image formed on a recording sheet can be easily improved.

Another aspect of the present invention provides an image forming apparatus including a recording head provided with a plurality of nozzles for ejecting ink droplets, a carriage mounting the recording head thereon, a velocity setting device that sets a target moving velocity of the carriage, and an image forming device that forms an image on a recording sheet facing the recording head. The image forming device moves the carriage in a main scanning direction at a velocity corresponding to the target moving velocity set by the velocity setting device and drives the recording head at a driving frequency proportional to the moving velocity of the carriage thereby to let the recording head eject ink droplets from each of the nozzles. The velocity setting device sets the target moving velocity of the carriage to a velocity within a velocity range where the ejection velocity of ink droplets from the nozzles is increased as the moving velocity of the carriage is increased. An actual moving velocity of the carriage stays within the velocity range.

If the image forming apparatus can set the target moving velocity of the carriage as above, fluctuation of the distance D can be controlled even if the carriage moving velocity is fluctuated due to cogging of a motor or eccentricity of a pulley. A shift in landing position of ink droplets from the target position can be inhibited. Image quality can be relatively easily improved.

BRIEF DESCRIPTION OF THE DRAWINGS

The invention will now be described below, by way of example, with reference to the accompanying drawings, in which:

FIG. 4 is a graph showing a change in time of a carriage moving velocity Vc caused by cogging and the like;

FIGS. 9A to 9C are graphs showing amounts of shift in landing position from an intended position of ink droplets due to cogging and the like;

DETAILED DESCRIPTION OF THE PREFERRED EMBODIMENT

Figure 1:
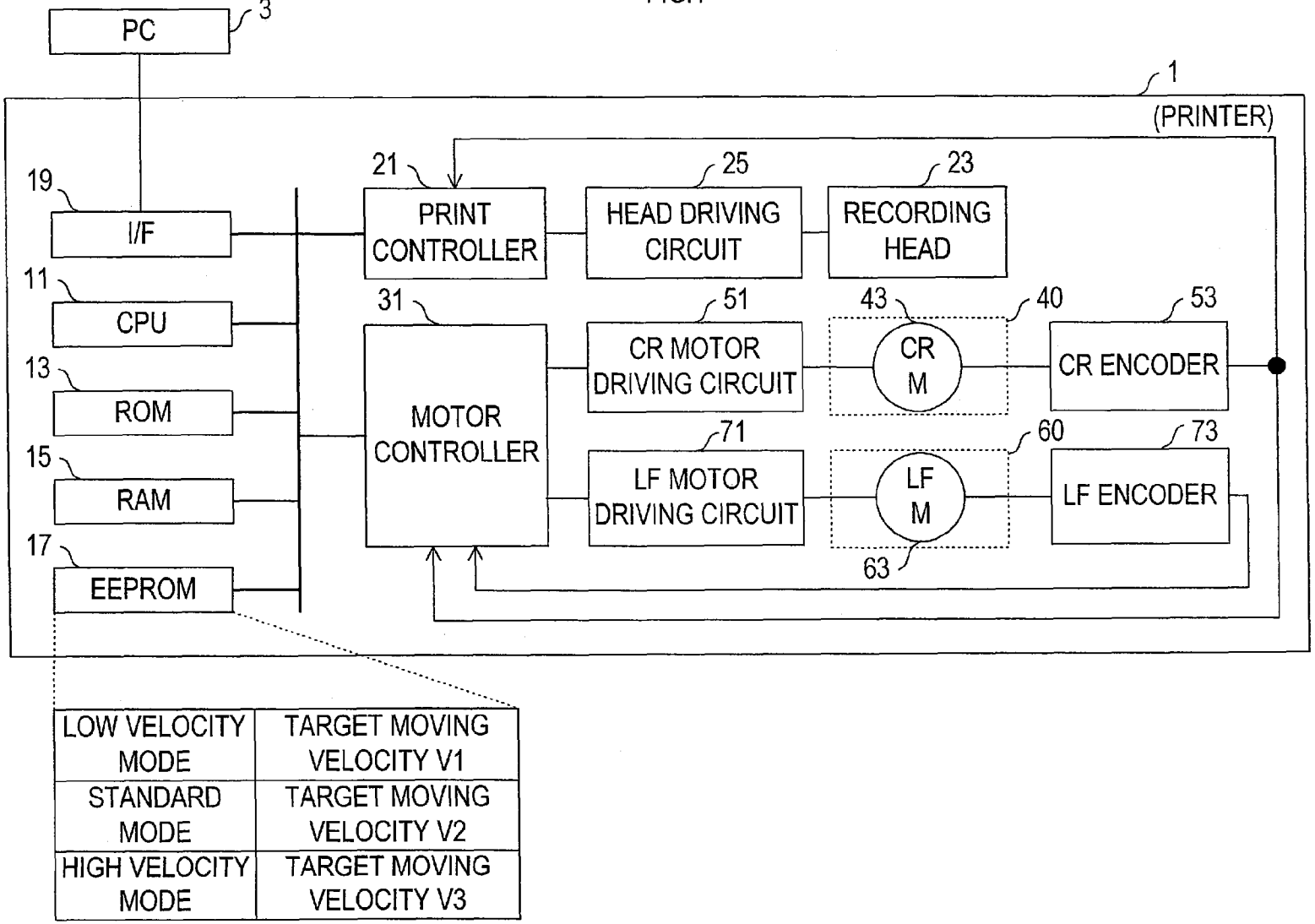
FIG. 1 is a block diagram showing a structure of a printer.

As shown in FIG. 1, a printer 1 of the present embodiment includes a CPU 11, a ROM 13, a RAM 15, an EEPROM 17, an interface 19 (USB interface, for example), an print controller 21 and a motor controller 31. The ROM 13 stores programs executed by the CPU 11. The RAM 15 is used as a working area at execution of the programs. The EEPROM 17 stores various setting information. The interface 19 is connected to a personal computer (PC) 3 and receives a print command and printing data transmitted from the PC 3.

The printer 1 also includes a recording head 23, a head driving circuit 25, a head conveyance mechanism 40, and a sheet conveyance mechanism 60. The recording head 23 is provided with a plurality of nozzles 24 arranged at the bottom for ejection of ink droplets. The head driving circuit 25 applies a driving voltage to the recording head 23 so as to drive the recording head 23. The head conveyance mechanism 40 includes a carriage 41 that conveys the recording head 23 in a main scanning direction and a CR motor 43 that moves the carriage 41 in the main scanning direction. The sheet conveyance mechanism 60 includes a conveyance roller 61 that conveys a sheet P to an ink ejection area and a LF motor 63 that rotates the conveyance roller 61. The CR motor 43 and the LF motor 63 are constituted of DC motors.

The printer 1 also includes a CR motor driving circuit 51, a CR encoder 53, a LF motor driving circuit 71, and a LF encoder 73. The CR motor driving circuit 51 drives the CR motor 43. The CR encoder 53 outputs pulse signals in accordance with positions of the carriage 41 moved by the CR motor 43. The LF motor driving circuit 71 drives the LF motor 63. The LF encoder 73 is constituted of a rotary encoder that outputs pulse signals each time the LF motor 63 is rotated by a predetermined angle.

Figure 2:
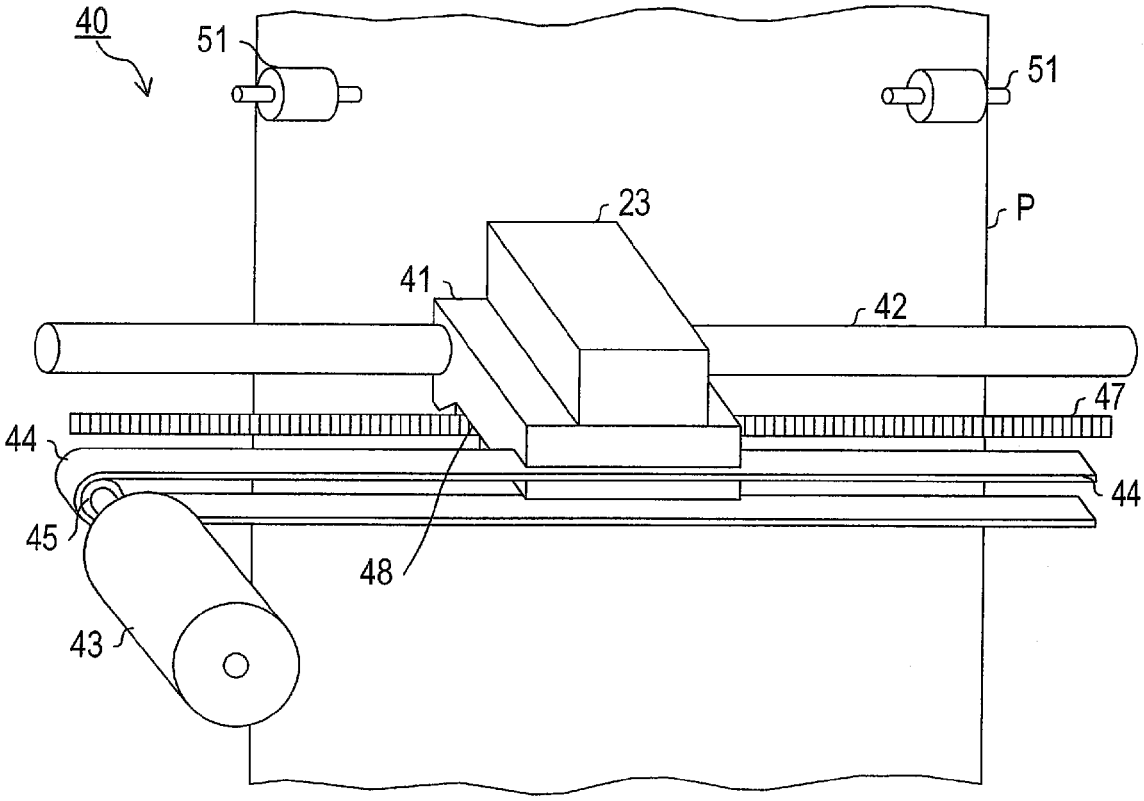
FIG. 2 is a perspective view showing a structure of a head conveyance mechanism.

Particularly, in the head conveyance mechanism 40, the carriage 41 is set so as to be able to move along a guide shaft 42 as shown in FIG. 2. The carriage 41 is connected to an endless belt 44. The endless belt 44 extends between a pulley 45 provided to a rotation shaft of the CR motor 43 and a not shown idle pulley. The endless belt 44 is designed to rotate by a rotational force of the CR motor 43 transmitted via the pulley 45. That is, in the head conveyance mechanism 40, the carriage 41 moves in the main scanning direction along the guide shaft 42 due to rotation of the endless belt 44 caused by the rotational force of the CR motor 43.

A timing slit 47 is provided in the printer 1. The timing slit 47 has slits formed at constant minute intervals along the guide shaft 42. A sensor element 48 is provided in the carriage 41. The sensor element 48 reads the intervals of the slits formed on the timing slit 47 to output pulse signals corresponding to positions of the carriage 41. That is, in the present embodiment, the timing slit 47 and the sensor element 48 constitute the CR encoder 53 as a linear encoder.

The recording head 23 is identical to a known piezoinkjet head. When a driving voltage is applied, a piezoelectric portion adjacent to an ink chamber is deformed to change a volume of the ink chamber so that ink inside the ink chamber is ejected toward a sheet from the nozzles 24. The recording head 23 is mounted on the carriage 41 and conveyed by the carriage 41 to move in the main scanning direction.

The recording head 23 is color printable. The nozzles 24 of the recording head 23, each of which respectively ejects ink droplets of either cyan (C), magenta (M), yellow (Y) or black (K), are sequentially arranged along the main scanning direction (see FIG. 6). Particularly, the recording head 23 of the present embodiment has a plurality of the nozzles 24 for the same color arranged in a sub-scanning direction (perpendicular direction on the FIG. 6 drawing). Thus, a single movement in the main scanning direction can form an image for a plurality of lines onto the sheet P.

The print controller 21, when started by a command from the CPU 11, controls the recording head 23 through the head driving circuit 25 based on pulse signals supplied from the CR encoder 53 and image data for each color supplied from the CPU 11. In this manner, an image corresponding to the image data is formed onto the sheet P. Particularly, the print controller 21, in the same manner as in a known printer, applies a driving voltage to the recording head 23 in synchronization with the movement of the carriage 41, based on pulse signals supplied from the CR encoder 53. The print controller 21 then lets the recording head 23 eject ink droplets at a frequency proportional to the moving velocity of the carriage 41.

The print controller 21 has three operation modes, that is, a standard mode, a low velocity mode and a high velocity mode. The print controller 21 operates in the operation mode specified by the CPU 11, and controls the recording head 23 such that ink droplets in size corresponding to the operation mode are ejected from the nozzles 24 in each of the operation modes. Switching of resolution of an image formed on the sheet P according to the operation mode is performed by changing the driving frequency of the recording head 23 (i.e., cycle at which ink droplets are ejected by the recording head 23) corresponding to the moving velocity of the carriage 41.

The motor controller 31, when started by a command from the CPU 11, controls the CR motor 43 through the CR motor driving circuit 51 such that the carriage 41 moves constant at the target moving velocity Vs. Particularly, the motor controller 31 detects the moving velocity (actual velocity) of the carriage 41 based on pulse signals supplied from the CR encoder 53 to perform feedback control so that the moving velocity and the target moving velocity Vs are consistent.

Also, the motor controller 31 controls the LF motor 63 such that the paper P is delivered by a predetermined amount each time the movement of the carriage 41 from one end to the other end is completed. Particularly, the motor controller 31 adjusts a manipulated variable to the LF motor 63 based on pulse signals supplied from the LF encoder 73 to control the LF motor 63 so that the sheet P is delivered for the predetermined amount.

Figure 3:
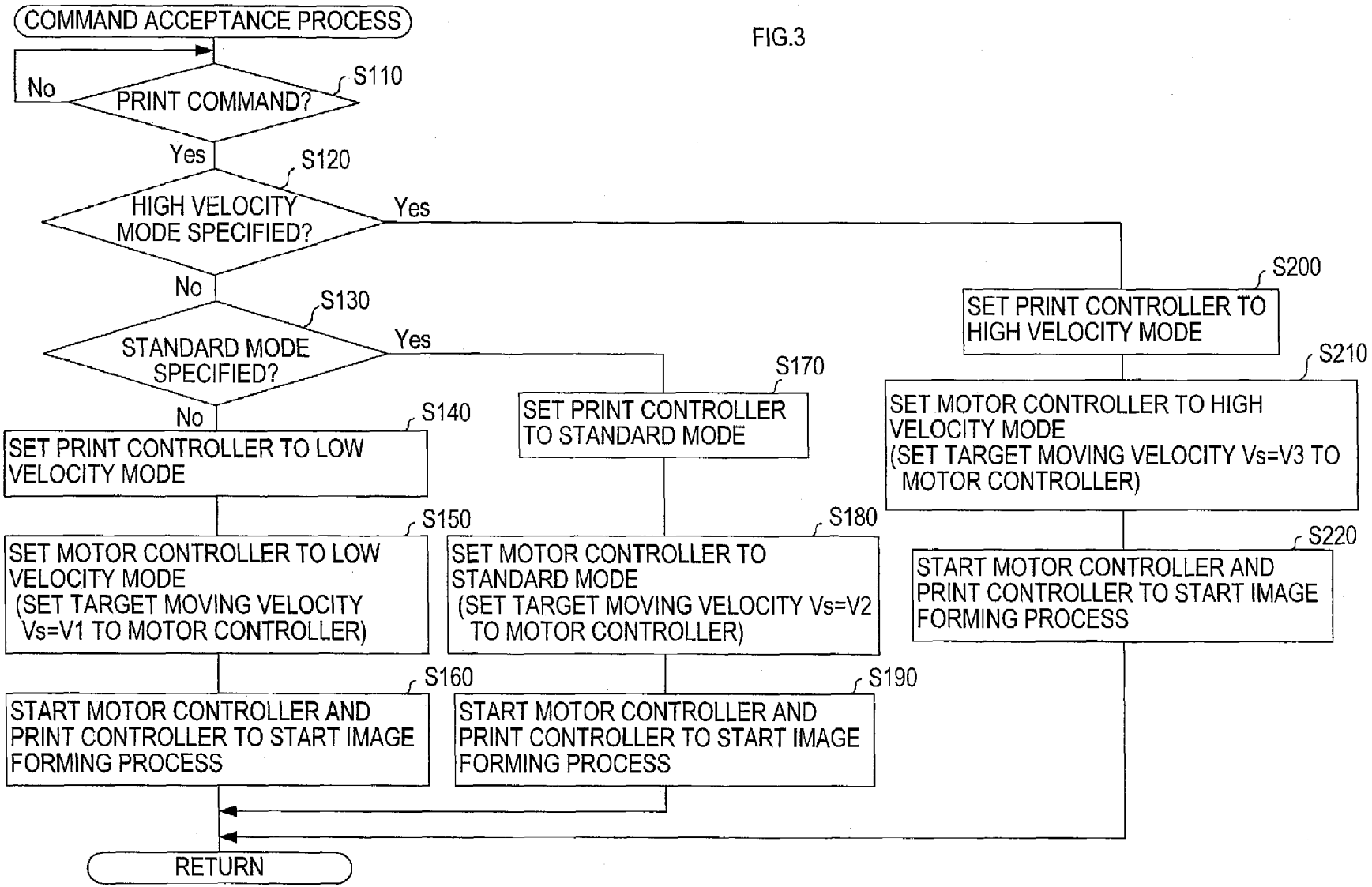
FIG. 3 is flowchart showing a command acceptance process executed by a CPU.

Now, a description is given on a command acceptance process executed by the CPU 11. FIG. 3 is a flowchart showing the command acceptance process repeatedly executed by the CPU 11 immediately after the start of the printer 1.

When the command acceptance process is started, the CPU 11 stands by until a print command is supplied from the PC 3 through the interface 19 (S110). When a print command is supplied (S110: Yes), it is then determined from the print command whether the operation mode specified by the PC 3 is the high velocity mode (S120). If it is determined that the operation mode is the high velocity mode (S120: Yes), the process moves to S200. If it is determined that the operation mode is not the high velocity mode (S120: No), the process moves to S130.

In S130, the CPU 11 determines from the print command whether the operation mode specified by the PC 3 is the standard mode. If it is determined that the operation mode is the standard velocity mode (S130: Yes), the process moves to S170. If it is determined that the operation mode is not the standard mode but the low velocity mode (S130: No), the process moves to S140.

In S140, the CPU 11 sets the operation mode of the print controller 21 to the low velocity mode. Also, a target moving velocity V1 indicated by velocity information for the low velocity mode stored in the EEPROM 17 is set to the target moving velocity Vs of the carriage 41 so that the motor controller 31 is set to the low velocity mode (S150).

As shown in FIG. 1, the printer 1 of the present invention has velocity information for each of the operation modes stored in the EEPROM 17. Each of the velocity information indicates a target moving velocity of the carriage 41 which can optimally inhibit a shift in landing position of ink droplets due to cogging of the CR motor 43, eccentricity of the pulley 45, etc.

After the step of S150, the process moves to S160. In S160, the CPU 11 starts the motor controller 31 and the print controller 21 to let the motor controller 31 execute control of the carriage 41 and to let the print controller 21 execute control of the recording head 21. Thereby, an image forming process is started onto the sheet P. At this time, the CPU 11 expands the image data of a print target, which has been supplied with the print command, into image data per color so as to supply the image data to the print controller 21.

In this manner, a color image based on the image data of the print target specified by the PC 3 is formed onto the sheet P in the printer 1 at the low velocity mode specified by the PC 3. After the step of S160, the command acceptance process is ended.

When the process moves to S170, the CPU 11 sets the operation mode of the print controller 21 to the standard mode. Also, a target moving velocity V2 indicated by velocity information for the standard mode stored in the EEPROM 17 is set to the target moving velocity Vs of the carriage 41 so that the motor controller 31 is set to the standard mode (S180). The process moves to S190.

In S190, the CPU 11 starts the motor controller 31 and the print controller 21 to let the motor controller 31 execute control of the carriage 41 and let the print controller 21 execute control of the recording head 21. Thereby, an image forming process is started onto the sheet P. At this time, the CPU 11 expands the image data of a print target, which has been supplied with the print command, into image data per color so as to supply the image data to the print controller 21.

In this manner, a color image based on the image data of a print target specified by the PC 3 is formed onto the sheet P in the printer 1 at the standard mode specified by the PC 3. After the step of S190, the command acceptance process is ended.

When the process moves to S200, the CPU 11 sets the operation mode of the print controller 21 to the high velocity mode. Also, a target moving velocity V3 indicated by velocity information for the high velocity mode stored in the EEPROM 17 is set to the target moving velocity Vs of the carriage 41 so that the motor controller 31 is set to the standard mode (S210). The process moves to S220.

In S220, the CPU 11 starts the motor controller 31 and the print controller 21 to let the motor controller 31 execute control of the carriage 41 and to let the print controller 21 execute control of the recording head 21. Thereby, an image forming process is started onto the sheet P. At this time, the CPU 11 expands the image data of a print target, which has been supplied with the print command, into image data per color so as to supply the image data to the print controller 21.

In this manner, a color image based on the image data of a print target specified by the PC 3 is formed onto the sheet P in the printer 1 at the high velocity mode specified by the PC 3. After the step of S220, the command acceptance process is ended.

Figure 4:
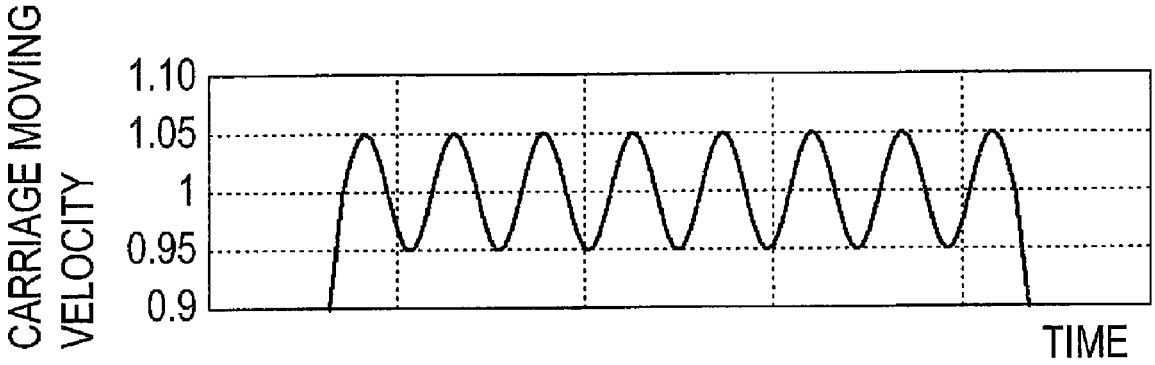

In the above image forming process according to the present embodiment, the CR motor 43 is controlled such that the carriage 41 moves in the main scanning direction at a constant velocity. However, as shown in FIG. 4, the moving velocity of the carriage 41 is slightly oscillated in practice due to cogging of the CR motor 43, eccentricity of the pulley 45, etc. FIG. 4 is a graph showing a change in time of the moving velocity Vc of the carriage 41 normalized by the target moving velocity Vs.

Figure 5:
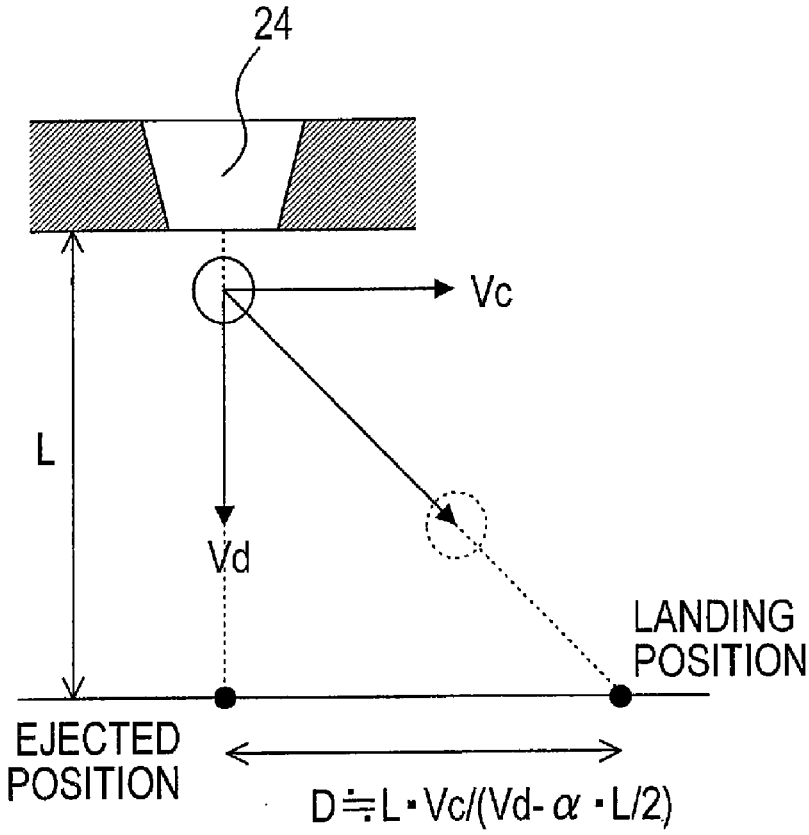
FIG. 5 is an explanatory view illustrating a relation among a distance D from an ejected position to a landing position of ink droplets, an ejection velocity Vd of the ink droplets, and the carriage moving velocity Vc.

The distance D from the ejected position of ink droplets ejected from the nozzles 24 to the landing position will be approximately as below. FIG. 5 is a view illustrating a relation among the distance D from an ejected position of ink droplets to a landing position, the ejection velocity Vd of ink droplets, and the carriage moving velocity Vc.

$$D \approx L \cdot Vc / \langle Vd \rangle \quad (1)$$

$$\langle Vd \rangle = Vd - \alpha \cdot L/2 \quad (2)$$

The ejected position here indicates a position where ink droplets when ejected from the nozzles 24 cast a reflection on the sheet P. The ejection velocity Vd of ink droplets here indicates an initial velocity of ink droplets ejected from the nozzles 24 in a coordinate system based on the moving carriage 41. A distance L indicates a distance from the face of the recording head 23 on which the nozzles 24 are formed to the paper P.

An average velocity of ejected ink droplets in an ink ejection direction is indicated by <Vd>, assuming that the ejected ink droplets are decelerated by a per unit distance due to air resistance. If assumed as such, the initial velocity of ink droplets in the ink ejection direction is the value Vd and the velocity of ink droplets in the ink ejection direction at landing is the value $(Vd-\alpha \cdot L)$. Thus, the average value <Vd> of ejected ink droplets in the ink ejection direction can be expressed as $\langle Vd \rangle = \{Vd + (Vd - \alpha \cdot L)\}/2 = Vd - \alpha \cdot L/2$. The equation (1) represents the distance D in approximation under these conditions.

Accordingly, in the printer 1, when the moving velocity Vc of the carriage 41 is fluctuated, the distance D is also affected and fluctuated. However, the printer 1 according to the present embodiment forms a color image onto the sheet P with ink of respective colors, that is, cyan, magenta, yellow and black. Therefore, if ink droplets of respective colors cannot be landed at the intended position due to the fluctuation of the distance D, image quality will be deteriorated.

In case that a color image is formed in a region G on the sheet P, it is necessary for ink droplets of the respective colors to be ejected toward the region G. However, since the respective nozzles 24 for cyan, magenta, yellow and black in the recording head 23 are arranged shifted from each other in the main scanning direction, ink droplets of the respective colors must be ejected toward the region G at different timings. In the present embodiment, on the assumption that the carriage 41 moves at the target moving velocity Vs, ink droplets are ejected sequentially from the nozzles 24 which reach a position a predetermined distance ahead of the region G. The predetermined distance is set in accordance with the target moving velocity Vs.

Figure 6:
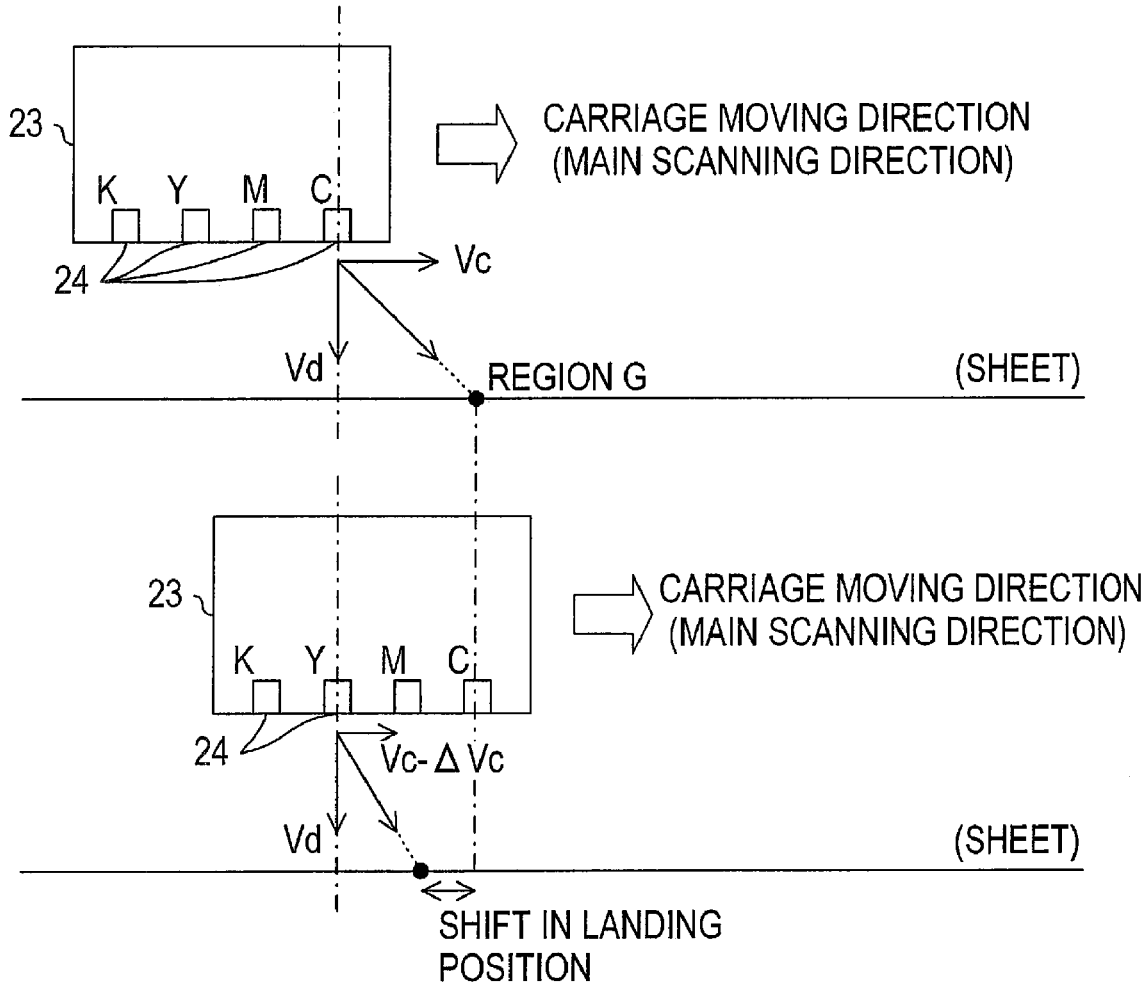
FIG. 6 is an explanatory view illustrating a shift in landing position of ink droplets for each color due to fluctuation in the carriage moving velocity Vc.

Accordingly, as shown in FIG. 6, if the moving velocity of the carriage 41 when ejecting ink droplets of yellow is low by $\Delta Vc$ as compared to the moving velocity of the carriage 41 when ejecting ink droplets of cyan, ink droplets of yellow are landed at a position short of the landing position of ink droplets of cyan. Thus, it is not possible to appropriately exhibit colors.

Such a shift in landing position cannot be avoided as long as there is fluctuation in the moving velocity Vc of the carriage 41. However, image quality formed on the sheet P largely depends on the amount of the shift in landing position. Therefore, it is preferable that the shift in landing position is as small as possible.

In order to decrease the amount of shift in landing position, it is first necessary to improve precision of velocity control of the carriage 41. However, there is a limit to the technique of improving precision of velocity control of the carriage 41. In the present embodiment, the target moving velocity Vs is set to a velocity which satisfies certain conditions in a relation between the carriage moving velocity Vc and the ejection velocity Vd of ink droplets. In this manner, the shift in landing position is controlled.

Figure 7A:
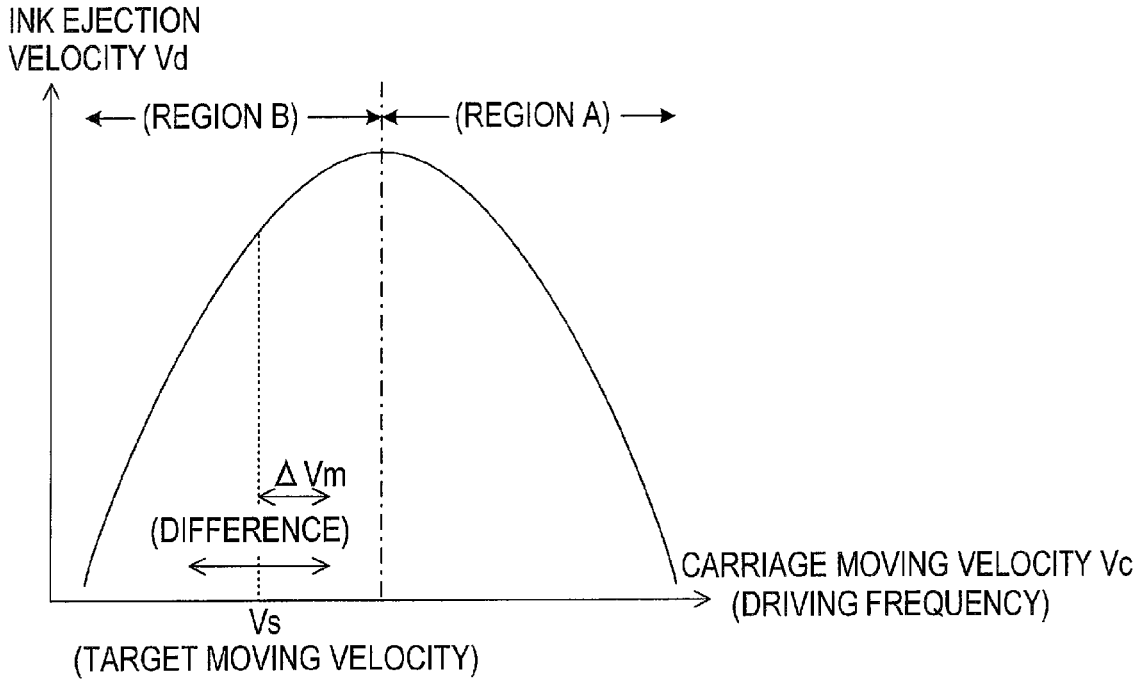
FIGS. 7A and 7B are graphs showing relations between the carriage moving velocity Vc and the ejection velocity Vd of ink droplets.

FIG. 7A is a graph showing a general relation between the carriage moving velocity Vc and the ejection velocity Vd of ink droplets. As shown in FIG. 7A, the ejection velocity Vd of ink droplets is not just monotonously increased or decreased over the whole section with respect to the carriage moving velocity Vc. There are sections where the ejection velocity Vd is monotonously increased and monotonously decreased with respect to the carriage moving velocity Vc.

As noted above, the carriage moving velocity Vc is proportional to the driving frequency of the recording head 23. Thus, the graph shown in FIG. 7A can be rearranged to a relation between the driving frequency and the ejection velocity Vd. The reason why the ejection velocity Vd is changed as shown in FIG. 7A in accordance with the driving frequency of the recording head 23 may be assumed as follows.

Figure 7B:
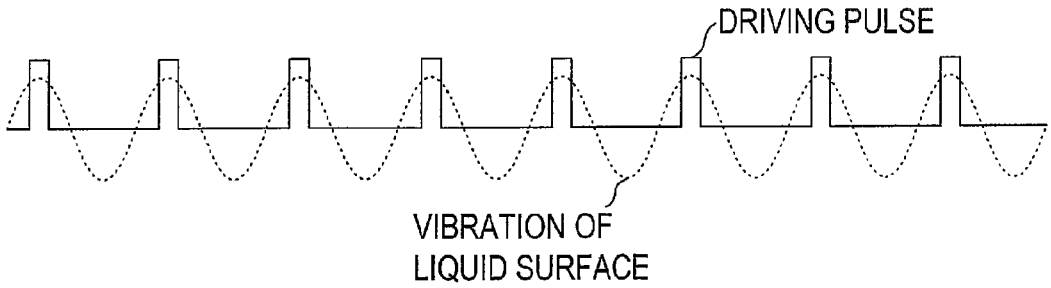

That is, when ink droplets are ejected from the nozzles 24 of the recording head 23, the liquid surface of ink inside the recording head 23 is vibrated by impact caused by ejection of ink droplets. The vibration remains after the ejection. Accordingly, if the cycle of the vibration is resonant with the input cycle of a driving pulse (driving voltage) to the recording head 23 at the next ejection of ink droplets, the ejection velocity Vd becomes high. FIG. 7B is a graph showing a pattern between the vibration and the driving pulse when the period of the vibration is resonant with the input cycle of a driving pulse to the recording head 23.

Figure 8A:
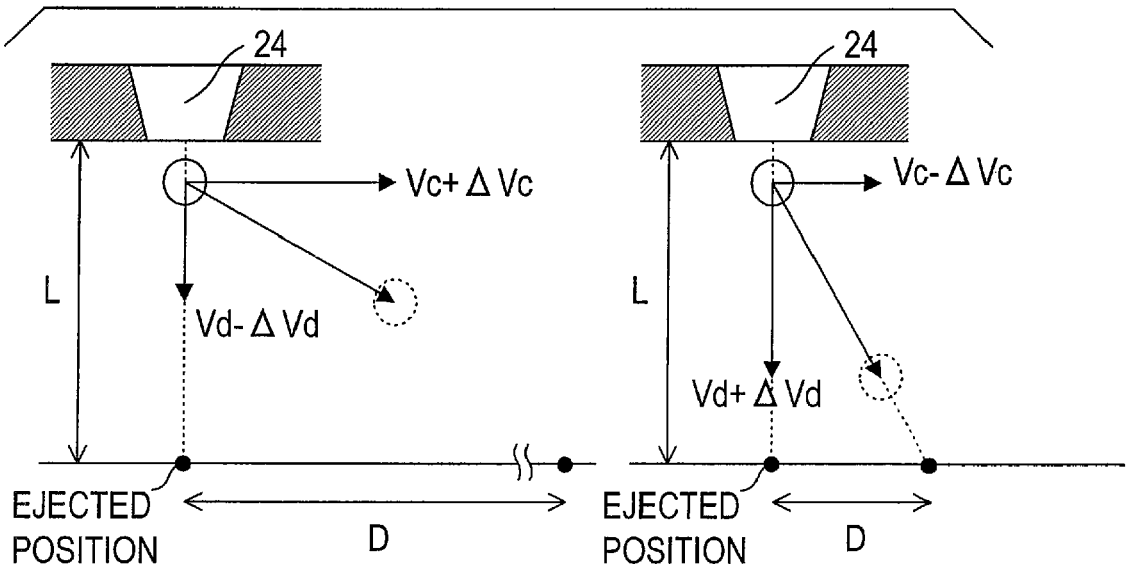
FIGS. 8A and 8B are explanatory views illustrating shifts in the distance D when the carriage moving velocity Vc is fluctuated.

Let us now consider how the distance D from the ejected position of ink droplets to the landing position is changed with respect to the ejection velocity Vd of ink droplets and the carriage moving velocity Vc. In the region A, the ejection velocity Vd is decreased when the carriage moving velocity Vc is increased, and the ejection velocity Vd is increased when the carriage moving velocity Vc is decreased. As shown in FIGS. 8A and 9B, the amount of shift in the distance D with respect to the change of the carriage moving velocity Vc becomes large in the region A as compared to the case where the ejection velocity Vd is constant regardless of the carriage moving velocity Vc.

Figure 8B:
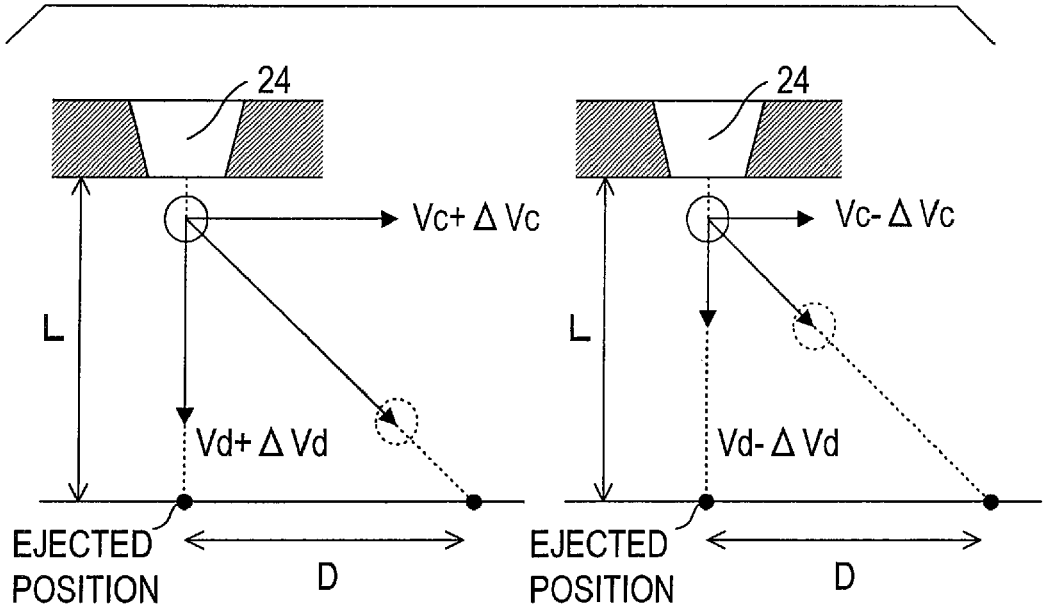

In the region B, the ejection velocity Vd is increased when the carriage moving velocity Vc is increased, and the ejection velocity Vd is decreased when the carriage moving velocity Vc is decreased. As shown in FIGS. 8B and 9C, the amount of shift in the distance D with respect to the shift in the carriage moving velocity Vc becomes small in the region B as compared to the case where the ejection velocity Vd is constant regardless of the carriage moving velocity Vc.

FIG. 8A is an explanatory view which visually illustrates the amount of shift in flying direction of ink droplets and the amount of shift in the distance D in the above region A. FIG. 8B is an explanatory view which visually illustrates the amount of shift in flying direction of ink droplets and the amount of shift in the distance D in the above region B.

Figure 9A:
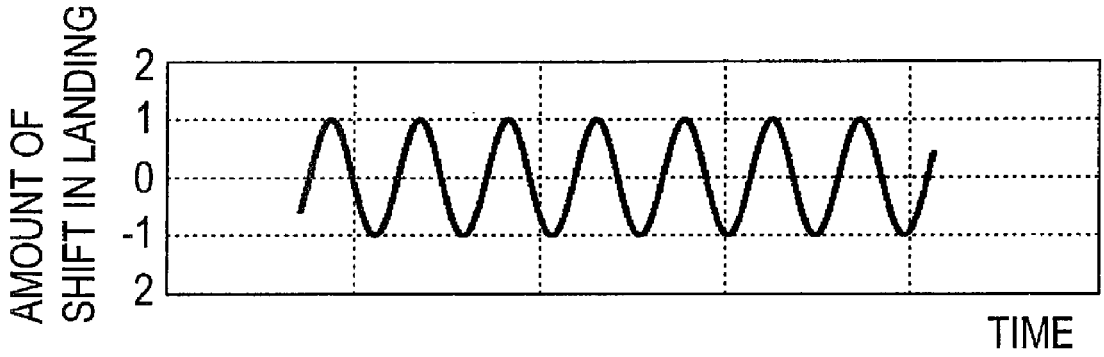
Figure 9B:
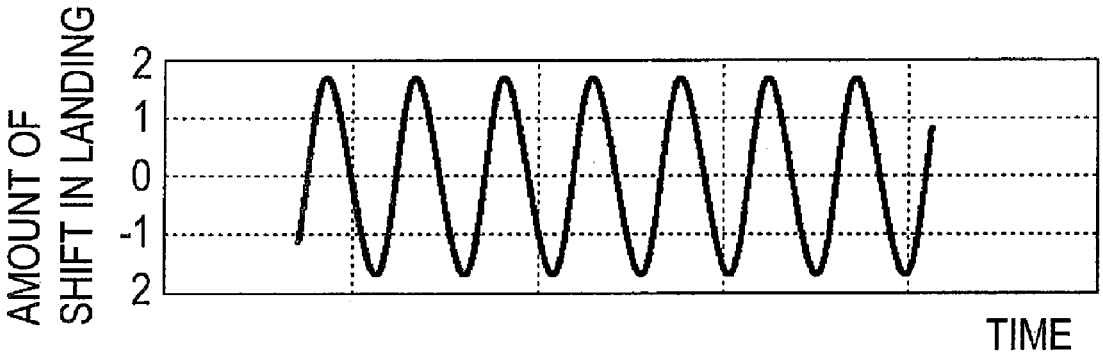
Figure 9C:
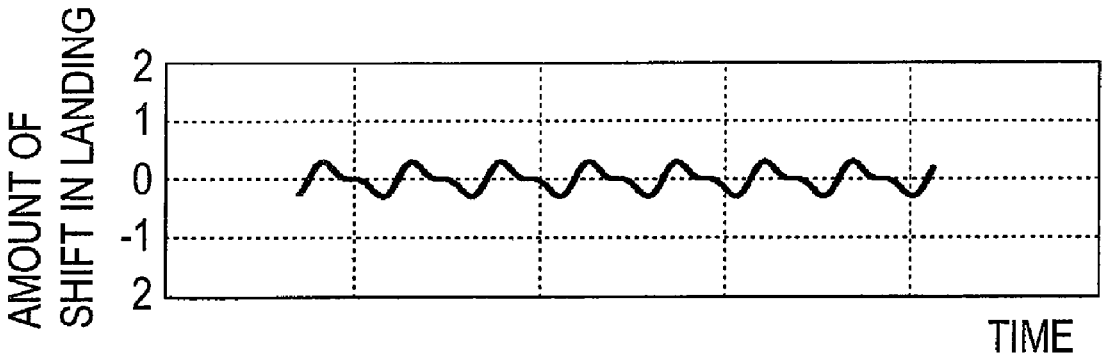

FIG. 9A is a graph showing the amount of shift in landing position of ink droplets from a target position on the assumption that the ejection velocity Vd of ink droplets is constant while the moving velocity of the carriage 41 is changed as shown in FIG. 4. FIG. 9B is a graph showing the amount of shift in landing position from a target position while the carriage moving velocity Vc is fluctuated within the above region A. FIG. 9C is a graph showing the amount of shift in landing position from a target position while the carriage moving velocity Vc is fluctuated within the above region B.

As shown in FIG. 9C, when the moving velocity Vc is shifted inside the region B, the amount of shift in landing position is kept dramatically low. Accordingly, in the present embodiment, a velocity within the region B where the ejection velocity of ink droplets from the nozzles 24 is increased as the moving velocity of the carriage 41 becomes high, and which, if set to the target moving velocity Vs, can maintain the moving velocity (actual velocity) of the carriage 41 within the region B is determined and recorded on the EEPROM 17 as the velocity information.

That is, in the present embodiment, the printer 1 sets the velocity having the aforementioned conditions to the motor controller 31 as the target moving velocity Vs, based on the velocity information recorded on the EEPROM 17. Thereby, the carriage 41 moves in the main scanning direction at the velocity under the above conditions in the image formation process.

Accordingly, the printer 1 can form a more favorable image without color shifts or the like than before. Image quality formed on the sheet P is improved. Also according to the present embodiment, without changing the mechanical structure of a conventional apparatus, improvement in image quality can be achieved simply by setting the target moving velocity Vs as above. Thus, the printer 1 with high quality can be provided at low costs.

Particularly, the velocity information for the respective operation modes can be generated in the following manner.

Figure 10A:
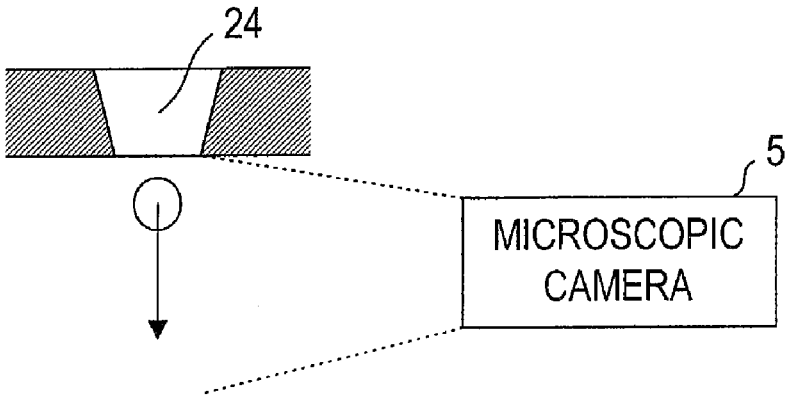
FIGS. 10A and 10B are explanatory views illustrating a method for measuring the ejection velocity Vd of ink droplets.

Firstly, the recording head 23 for use in the printer 1 is fixed to the position where a microscopic camera 5 can take shots of the vicinity of the nozzles 24, as shown in FIG. 10A. Secondly, per operation mode, a range of the driving frequency selectable when the recording head 23 is operated in the corresponding operation mode is set to a measurement range of the ejection voltage Vd of ink droplets.

Figure 10B:
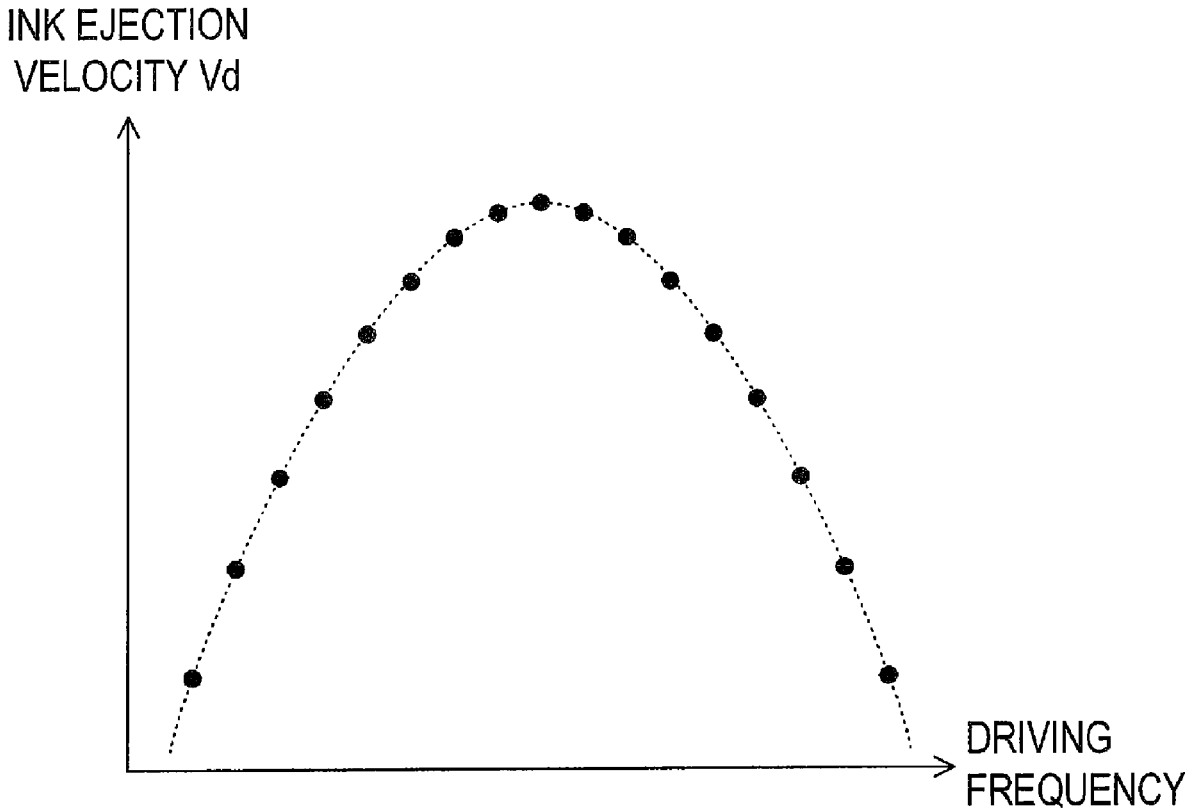

A plural number of driving frequencies to be measured are selected from the measurement range. The recording head 23 is operated at the respective selected driving frequencies to perform continuous shooting of ink droplets ejected from the nozzles 24 with the microscopic camera 5. At this time, the recording head 23 is operated at each of the selected driving frequencies so that ink droplets of the droplet size corresponding to the operation mode are ejected from the nozzles 24 at a cycle corresponding to the driving frequency. The microscopic camera 5 is operated in conjunction with the ejecting operation of the ink droplets so as to take shots of the position of ink droplets per ejecting operation after a predetermined time (100 μs, for example) from ejection of the ink droplets from the nozzles 24. Thereafter, from these shots, an average of a distance which ink droplets have moved from ejection from the nozzles 24 until a lapse of the predetermined time is calculated per driving mode and driving frequency. The distance is divided by the predetermined time to figure out the ejection velocity Vd of ink droplets at every driving frequency (see FIG. 10B).

The ejection velocity Vd of ink droplets is also varied depending on the size of the ink droplets. Therefore, in order to design the printer 1 to form an image using ink droplets of a plurality of sizes in each operation mode, ink droplets of a common droplet size having the highest ejection frequency in the corresponding operation mode should be ejected from the recording head 23 at the time of measurement, thereby calculating the ejection velocity Vd of ink droplets of the common droplet size.

Figure 11:
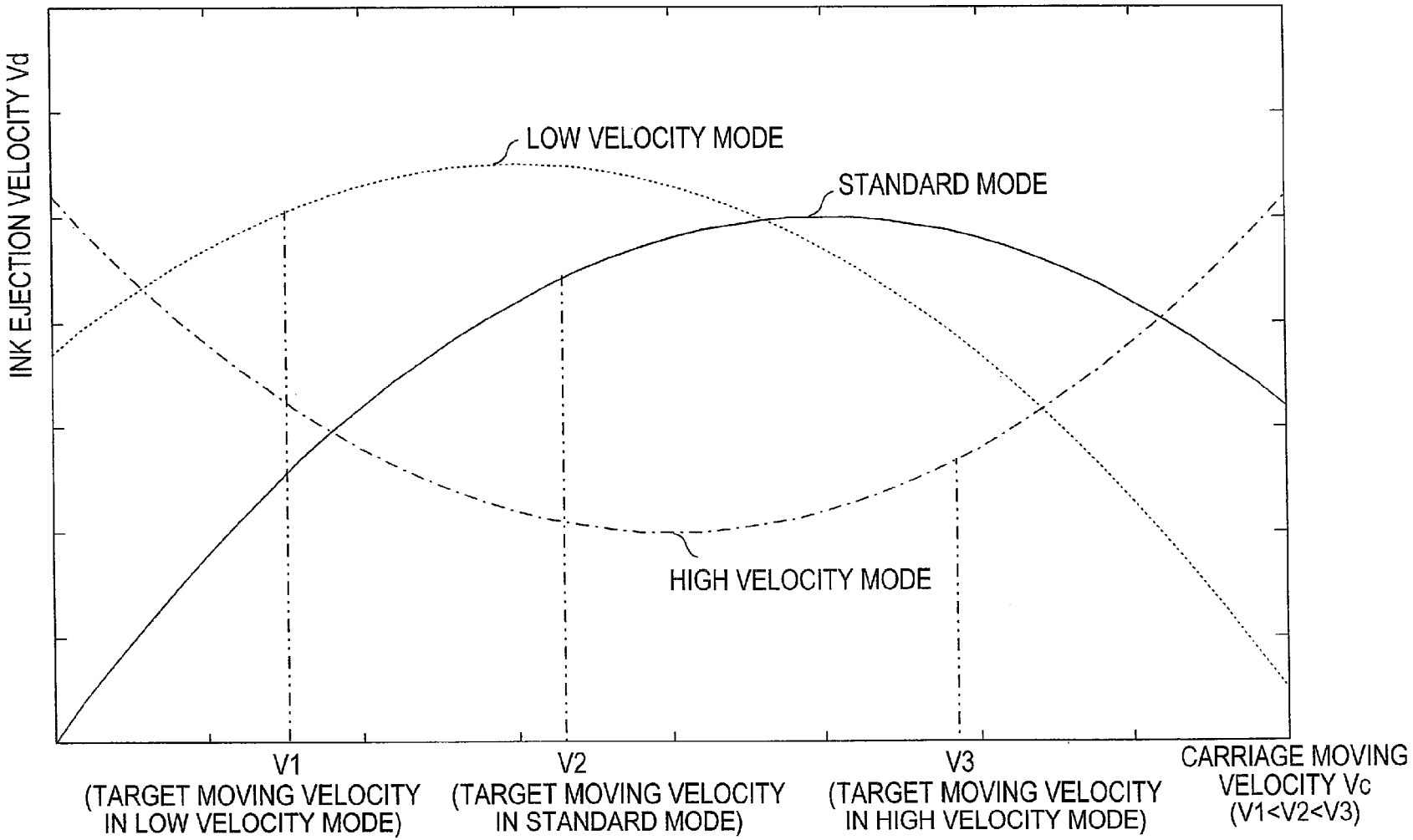
FIG. 11 is a graph showing the carriage moving velocity Vc and the ejection velocity Vd of ink droplets in each mode.

After the ejection velocity Vd of ink droplets is calculated per driving frequency in the measurement range and per operation mode, a relation between the driving frequency and the ejection velocity Vd of ink droplets obtained as a result of the above calculation is rearranged to a relation between the carriage moving velocity Vc and the ejection velocity Vd of ink droplets per operation mode, in accordance with a proportional relation between the driving frequency adopted at each operation mode and the carriage moving velocity Vc. Then, this relation is expressed in a graph having an x axis representing the carriage moving velocity Vc and a y axis representing the ejection velocity Vd of ink droplets (see FIG. 11).

In this manner, the relation between the carriage moving velocity Vc and the ejection velocity Vd of ink droplets in each operation mode is visually identified in the present embodiment.

Thereafter, the most suitable target moving velocity Vs of the carriage 41 in each mode is determined based on the above graph, in consideration of the fluctuation of the carriage moving velocity Vc caused by cogging or eccentricity of a pulley. Information on the amount of fluctuation of the carriage moving velocity Vc can be obtained by operating the printer 1 and calculating the moving velocity of the carriage 41 from the output of the CR encoder 53.

Particularly, if the maximum amount of fluctuation of the moving velocity Vc of the carriage 41 is ΔVm in case that the constant driving control of the carriage 41 is performed by the motor controller 31, the velocity Vs which can monotonously increase the ejection velocity Vd of ink droplets in a section of Vc=(Vs−ΔVm) to Vc=(Vs+ΔVm) is calculated based on the above graph of the corresponding operation mode. For example, the most suitable target moving velocity Vs in the standard mode is obtained in the above manner based on the graph of the standard mode.

After the most suitable target moving velocity Vs in each mode are calculated in this manner, the calculated target moving velocity Vs is stored together with identification information of the operation mode per every operation mode thereby to generate velocity information of each operation mode. The generated velocity information of each operation mode is stored in the EEPROM 17.

The present invention is not limited to the above embodiment, and can be carried out in various manners.

For instance, the present invention is applied to a process relating to color printing in the above embodiment. However, the present invention may be applied to a process relating to monochrome printing.

What is claimed is:

1. A method for setting a target moving velocity of a carriage in an image forming apparatus wherein a recording head is driven at a driving frequency proportional to a moving velocity of the carriage, the method comprising steps of:

measuring an ejection velocity of ink droplets ejected from nozzles of the recording head by varying the driving frequency of the recording head proportional to the moving velocity of the carriage;

deriving a velocity range where the ejection velocity of ink droplets from the nozzles of the recording head is increased as the moving velocity of the carriage is increased;

calculating a control error between the target moving velocity and an actual moving velocity of the carriage; and setting the target moving velocity of the carriage such that the actual moving velocity of the carriage stays within the velocity range based on the calculated control error.

2. The method set forth in claim 1, wherein the step of measuring the ejection velocity of ink droplets and the step of deriving the velocity range are carried out per operation mode corresponding to a size of ejected droplets, and the target moving velocity of the carriage is set per operation mode.

3. The method set forth in claim 1, wherein the step of measuring the ejection velocity of ink droplets includes a step of rearranging a relation between the driving frequency of the recording head and the ejection velocity of ink droplets to a relation between the moving velocity of the carriage and the ejection velocity of ink droplets, in accordance with a proportional relation between the driving frequency of the recording head and the moving velocity of the carriage.

4. The method set forth in claim 3, further comprising a step of:

making a graph of the relation between the moving velocity of the carriage and the ejection velocity of ink droplets, wherein the target moving velocity of the carriage is set based on the graph.

5. The method set forth in claim 4, further comprising a step of:

obtaining from the graph a velocity range in which the ejection velocity of ink droplets is monotonously increased in a fluctuation range of the moving velocity of the carriage to set the moving velocity of the carriage.

6. The method set forth in claim 1, wherein the step of setting the target velocity of the carriage includes a step of storing velocity information indicating the target moving velocity in a storage device.

7. The method set forth in claim 6, wherein the velocity information is stored in the storage device per operation mode corresponding to a size of ejected ink droplets.

8. An image forming apparatus comprising:

a recording head provided with a plurality of nozzles for ejecting ink droplets, a carriage mounting the recording head thereon, a velocity setting device that sets a target moving velocity of the carriage, and an image forming device that forms an image on a recording sheet facing the recording head, wherein the image forming device moves the carriage in a main scanning direction at a velocity corresponding to the target moving velocity set by the velocity setting device and drives the recording head at a driving frequency proportional to the moving velocity of the carriage to let the recording head eject ink droplets from each of the nozzles, the velocity setting device sets the target moving velocity of the carriage to a velocity within a velocity range where the ejection velocity of ink droplets from the nozzles is increased as the moving velocity of the carriage is increased, and an actual moving velocity of the carriage stays within the velocity range.

9. The image forming apparatus set forth in claim 8, further comprising a storage device that stores velocity information indicating the target moving velocity, the target moving velocity being a velocity within a velocity range where the ejection velocity of ink droplets from the nozzles is increased as the moving velocity of the carriage is increased, and the actual moving velocity of the carriage staying within the velocity range, the velocity setting device sets the target moving velocity of the carriage based on the velocity information stored in the storage device.

10. The image forming apparatus set forth in claim 9 wherein the image forming device has a plurality of operation modes, and ink droplets of a size corresponding to each of the operation modes are ejected from the nozzles in each of the operation modes to form an image onto a recording sheet, the storage device has the velocity information per each of the operation modes of the image forming device, the velocity setting device reads the velocity information corresponding to each of the operation modes of the image forming device from the storage device, and sets the target moving velocity of the carriage based on the read velocity information.

* * * * *